US010009968B2

(12) United States Patent
Chen et al.

(10) Patent No.: US 10,009,968 B2
(45) Date of Patent: Jun. 26, 2018

(54) PFM SCHEME FOR BOOST AND FLYBACK CONVERTER IN LED BACKLIGHT APPLICATION

(71) Applicant: Apple Inc., Cupertino, CA (US)

(72) Inventors: Jingdong Chen, San Jose, CA (US); Asif Hussain, San Jose, CA (US); Behzad Mohtashemi, Los Gatos, CA (US); Manisha P. Pandya, Sunnyvale, CA (US); Mohammad J. Navabi-Shirazi, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

(21) Appl. No.: 15/069,724

(22) Filed: Mar. 14, 2016

(65) Prior Publication Data

US 2016/0345395 A1 Nov. 24, 2016

Related U.S. Application Data

(60) Provisional application No. 62/165,541, filed on May 22, 2015.

(51) Int. Cl.
*H05B 33/08* (2006.01)
*G09G 3/34* (2006.01)

(52) U.S. Cl.
CPC ..... *H05B 33/0815* (2013.01); *G09G 3/3406* (2013.01); *H05B 33/086* (2013.01); *G09G 2330/06* (2013.01)

(58) Field of Classification Search
CPC ..... H05B 33/0815
See application file for complete search history.

(56) References Cited

U.S. PATENT DOCUMENTS

| | | | | |
|---|---|---|---|---|
| 8,014,176 | B2 | 9/2011 | Melanson et al. | |
| 8,339,816 | B2 | 12/2012 | Saji | |
| 2008/0169796 | A1* | 7/2008 | Buethker | H02M 3/1582 323/282 |
| 2010/0061124 | A1 | 3/2010 | Gong et al. | |
| 2010/0225293 | A1* | 9/2010 | Wang | H02M 3/33507 323/290 |
| 2014/0354170 | A1* | 12/2014 | Gredler | H05B 33/0815 315/224 |

OTHER PUBLICATIONS

Sengupta, Upal. "PWM and PFM operation of DC/DC converters for portable applications." TI Literature No. SLPT015 (2007).*

* cited by examiner

*Primary Examiner* — Jimmy Vu
*Assistant Examiner* — Pedro C Fernandez
(74) *Attorney, Agent, or Firm* — McDermott Will & Emery LLP

(57) ABSTRACT

This application relates to systems, methods, and apparatus for controlling a switching frequency of a boost or flyback converter to be above an audible frequency range when operating the boost or flyback converter in a pulse frequency modulation (PFM) mode. The boost or flyback converter uses one or more switches for converting power for a display panel. In order to boost the switching frequency when operating in the PFM mode, the boost or flyback converter can selectively implement certain current and/or voltage limits for pulses that are generated as a result of the switching. The current and/or voltage limits can be set according to a load of the boost or flyback converter, and a correspondence between the current and/or voltage limits and the loads can be stored in a lookup table accessible to the boost or flyback converter.

13 Claims, 7 Drawing Sheets

PFM SCHEME FOR BOOST AND FLYBACK CONVERTER IN LED BACKLIGHT APPLICATION

CROSS-REFERENCE TO RELATED APPLICATION

The present application claims the benefit of U.S. Provisional Application No. 62/165,541, entitled "PFM SCHEME FOR BOOST CONVERTER IN LED BACKLIGHT APPLICATION," filed May 22, 2015, the content of which is incorporated herein by reference in its entirety for all purposes.

FIELD

The described embodiments relate generally to power management schemes for display devices. More particularly, the present embodiments relate to using a pulse frequency modulation (PFM) scheme to reduce audible noise and electromagnetic interference at a display device.

BACKGROUND

Power management in computing devices has become increasingly difficult given the number of tasks handled by certain personal computing devices. While various strategies exist for managing power within a computing device, many strategies fall short of improving the user experience. In some computing devices, power converting devices are incorporated in order to supply different power signals to different portions of the computing devices. Unfortunately, these power converting devices can generate audible noise and electromagnetic interference (EMI) when operating in certain low power modes. The audible noise and EMI can originate from switches within the power converting devices when a switching frequency of the switches falls to an audible frequency range. As a result certain subsystems of a computing device can be affected and the user experience can be negatively impacted.

SUMMARY

This paper describes various embodiments that relate to a boost converter that is operable in a pulse frequency modulation mode (PFM) and can selectively identify current and/or voltage limits while in the PFM mode to reduce audible noise generated by the boost converter. In some embodiments, a boost converter for a display panel is set forth. The boost converter can include a logic circuit configured to switch the boost converter into a pulse width modulation (PWM) mode when a load of the boost converter is above a load threshold and a pulse frequency modulation mode (PFM) mode when the load of the boost converter is equal to or below the load threshold. The boost converter can further include a controller configured to monitor a current output of the boost converter and limit the current output to a predetermined current limit when operating in the PFM mode. In this way, the boost converter can increase a burst frequency of the current output above a predetermined frequency threshold.

In other embodiments, a method for operating a boost converter above a predetermined frequency is set forth. The method can include switching from a PWM mode to a PFM mode when a load of the boost converter is below a predetermined load threshold. The method can further include outputting a series of pulses from the boost converter, and throttling the series of pulses when the series of pulses causes a voltage output of the boost converter to reach a voltage threshold. A switching frequency of the boost converter can be configured above a frequency threshold when providing the series of pulses.

In yet other embodiments, a computing device is set forth. The computing device can include a display panel connected to a backlight. The computing device can further include a flyback converter that can include a first current sensor connected to a primary side of a transformer, a second current sensor connected to a secondary side of the transformer, and a logic component. The logic component can be configured to output a current pulse in response to a first current sensor output reaching a primary current limit and a second current sensor output reaching zero current. The second current sensor can be a zero cross detection circuit. The logic component can further be configured to turn off the flyback converter when an output voltage to the backlight reaches a predetermined voltage threshold.

Other aspects and advantages of the embodiments discussed herein will become apparent from the following detailed description taken in conjunction with the accompanying drawings which illustrate, by way of example, the principles of the described embodiments.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
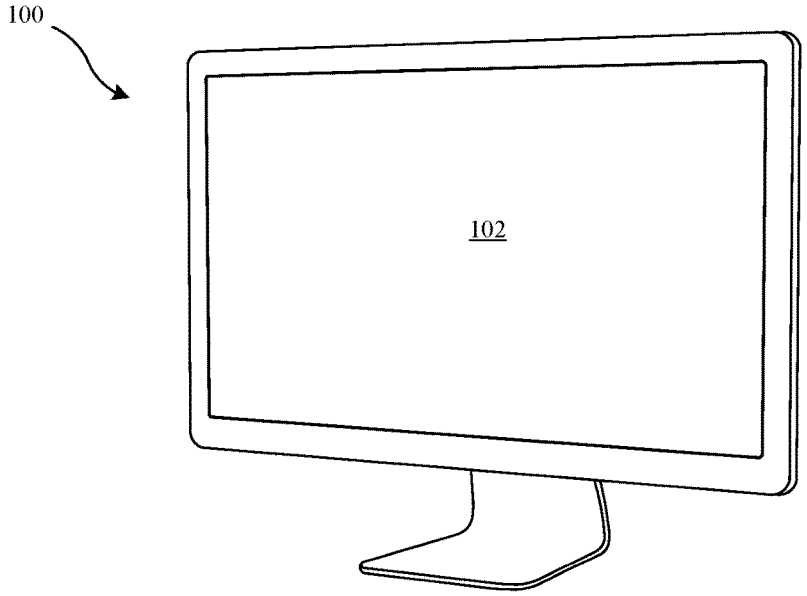
FIGS. 1A and 1B illustrate perspective views of a simplified circuit of a display panel and a light emitting diode (LED) array.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Many computing devices have power management schemes for saving power when certain operating parameters are met. In computing devices that incorporate display panels, often times the display panel consumes a large majority of power in the computing device compared to other subsystems within the computing device. In order to reduce the power consumption of such display panels, many computing devices offer controls for reducing how much energy can be received by the display panel. Unfortunately, reducing the energy availability to the display panel can mean reducing a switching frequency of a power converter connected to the display panel. As a result, audible noise and electromagnetic interference (EMI) can be output by the power converter, which can affect other portions of the computing device as well as the user experience.

In order to improve the power efficiency of display devices, a power management scheme is provided herein that allows a boost converter connected to a display device to switch between a pulse width modulation (PWM) mode and a pulse frequency modulation (PFM) mode. The boost converter can switch between the PWM mode and the PFM mode when a load of the boost converter is equal to or below a predetermined threshold load for the boost converter. Once in the PFM mode, the boost converter can provide an output that is generated according to a switching frequency of the boost converter. The switching frequency corresponds to one or more switches of the boost converter that are configured to provide pulses used to generate a voltage output from the boost converter. The switching frequency can be maintained above a predetermined frequency threshold corresponding to an audible frequency limit. In this way, when operating above the predetermined frequency threshold, the boost converter will not produce any audible sound.

The switching frequency for the boost converter can be based on one or more operating parameters of the boost converter. For example, each pulse generated by the boost converter can be limited according to an upper current limit and a current zero crossing corresponding to an inductor current of the boost converter. In this way, the pulse can be provided until the inductor current reaches the upper current limit. When the upper current limit is reached, the pulse can be throttled until the inductor current reaches zero. Thereafter, and in response to the inductor current reaching zero, a subsequent pulse can be generated and similarly throttled. According to the operation of the boost converter, the pulses will cause a voltage output to be provided from the boost converter as a capacitor connected to the boost converter is charged by the pulses and thereafter discharged. The discharge of the capacitor can be performed when the pulses bring the voltage output of the boost converter to an upper voltage threshold. Once the voltage output falls to or below a lower voltage threshold, the pulses can continue to be generated by the boost converter. In order to reduce any audible noise and EMI created by the pulses, the limits and thresholds associated with the inductor current and/or voltage output can be optimized in order to provide a switching frequency for the pulses that is above an audible frequency.

In some embodiments of the boost converter discussed herein, the limits on the inductor current during the PFM mode can be based on a high side current measurement of the inductor current of the boost converter. The high side current can refer to a current moving through an inductor of the converter. In other embodiments, the limits on the inductor current can be based on both a primary side current measurement and a secondary side current measurement at the flyback converter. The primary side of the flyback converter can be connected to a voltage input side of a transformer of the flyback converter. The secondary side of the flyback converter can refer to a side of the transformer that is connected to a switch (e.g., a field effect transistor (FET)) and capacitor that distributes the output voltage. In this way, the limits on the inductor current can be based on whether the primary side current measurement has reached an upper current limit and the secondary side current measurement has reached zero.

In any of the embodiments discussed herein, the limits can be set such that the switching frequency is boosted when the boost converter enters the PFM mode, which can occur as a result of a load of the boost converter falling below a load threshold. As the load continues to fall below the load threshold, the inductor current and/or an output voltage of the boost converter can be adjusted to maintain the switching frequency of the boost converter above an audible frequency. The output voltage can correspond to a ripple voltage of the boost converter that is exhibited when the output voltage is rising or falling. Both the output voltage and the inductor current can be set as fixed or variable values when the boost converter is in the PFM mode. For example, the output voltage can be set to a fixed voltage and the inductor current can be limited to a range of values set by the boost converter. Additionally, in some embodiments, the output voltage can be limited to a range of values set by the boost converter and the inductor current can be set to a fixed value. In this way, when the boost converter is forced to maintain a certain inductor current or a certain output voltage, the switching frequency of the boost converter can be limited to those frequencies that are above an audible frequency range.

The boost converter can store or access data that provides a correspondence between inductor current limits, output voltage limits, and/or load of the boost converter for causing the switching frequency of the boost converter to be above an audible frequency range. The correspondence between the values for inductor current limit, output voltage limit, and/or load can be based on a previous calibration of the boost converter. Additionally, the correspondence can be embodied in one or more lookup tables that are stored by or accessible to the boost converter. In this way, when the a load of the boost converter falls to a certain load value, the boost converter can query the lookup table to find a correspondence between the certain load value and an inductor current limit and/or output voltage limit. Once the boost converter identifies the inductor current limit and/or output voltage limit that corresponds to the certain load value, the boost converter can operate according to the inductor current and the output voltage.

These and other embodiments are discussed below with reference to FIGS. 1A-7; however, those skilled in the art will readily appreciate that the detailed description given herein with respect to these figures is for explanatory purposes only and should not be construed as limiting.

Figure 1B:
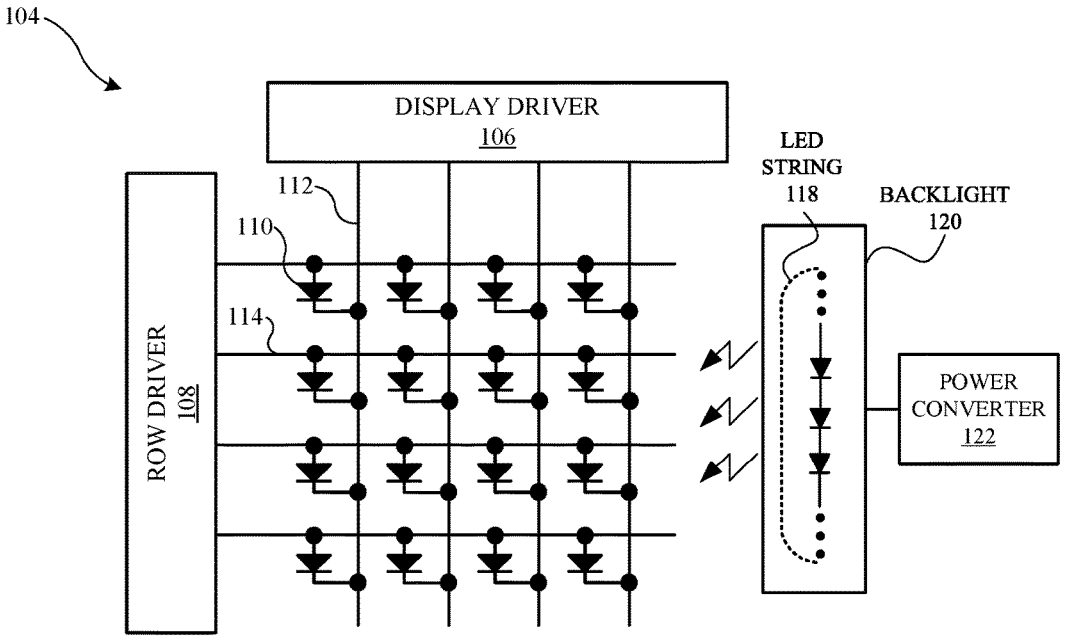

FIGS. 1A and 1B illustrate perspective views 100 of a display panel 102 and a light emitting diode (LED) array 104. The display panel 102 can be a display panel using an LED array 104 and backlight to output light at the display panel 102. It should be noted that the term display panel as used herein can refer to the display of a laptop computing device, desktop computing device, media player, cellular phone, television, or any other electronic device incorporating a display having LEDs and/or organic light emitting diodes (OLEDs). FIG. 1B illustrates an LED array 104 for use in the display panel 102, or any other suitable display device, in combination with a backlight 120. The backlight 120 can include one or more LED strings 118, and each LED string 118 can include one or more interconnected LEDs. The backlight 120 can be powered by a power converter 122 such as a boost converter or flyback converter, as discussed herein. In order to cause an LED 110 to illuminate, each column line 112 and row line 114 is individually provided electrical current, and the backlight 120 is powered on by the power converter 122.

When the LED array 104 is incorporated in a battery powered computing device, power efficiency can be a major concern for designers of the LED array 104 and backlight 120. In order to improve the power efficiency, the computing device can be designed to operate in a low power mode where the load on certain components of the computing device can be reduced. Some components, however, can exhibit audible noise when operating at a reduced load. For example, the computing device can incorporate a boost converter for converting power for the backlight of a display connected to the computing device. The boost converter can incorporate one or more switches that are used to convert the power for the backlight. However, when the boost converter is operating in a low power mode, the switching frequency can fall into an audible range thereby generating audible noise as a result. In order to eliminate this audible noise while also providing a power efficient boost converter, the boost converter can be configured to operate in a pulse width modulation (PWM) at certain loads and a pulse frequency modulation (PFM) mode at certain other loads. The PFM mode can be designed such that the boost converter operates according to certain output current limits and/or output voltage limits that cause the switching frequency of the boost converter to be above an audible frequency range, as discussed herein.

Figure 2:
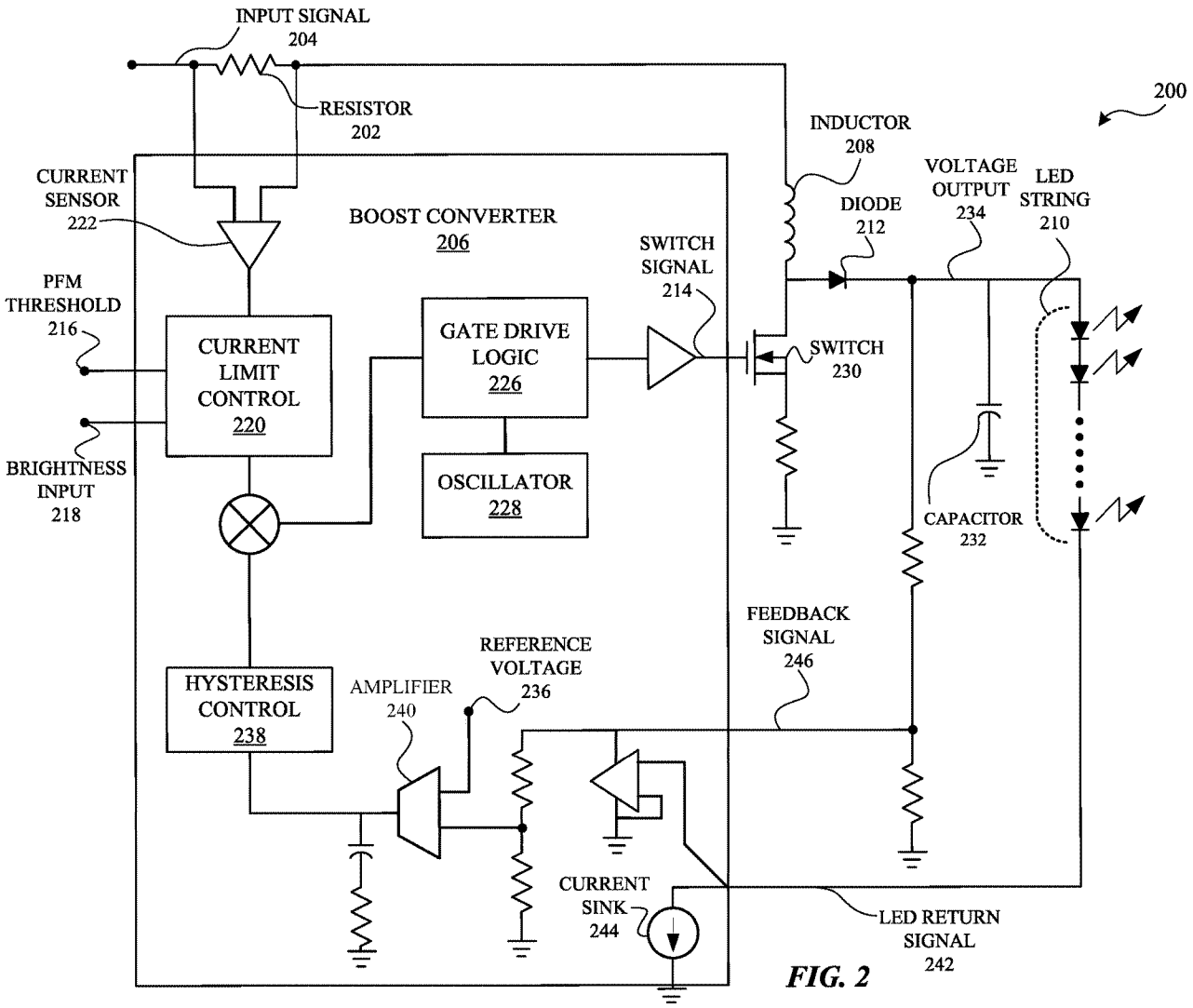
FIG. 2 illustrates a circuit diagram of a boost converter that can operate in a PFM mode discussed herein for mitigating audible switching at the display panel.

FIG. 2 illustrates a circuit diagram 200 of a boost converter 206 that can operate in the PFM mode discussed herein for mitigating audible switching at a display panel to which the boost converter 206 can be connected. The boost converter 206 can operate in a PWM mode or a PFM mode depending on a load that is being driven by the boost converter 206. The boost converter 206 can enter the PFM mode when an output of a current sensor 222 is below a PFM threshold 216. The current sensor 222 can measure current across a resistor 202 and use the measured current to control the operations of the boost converter 206 when in the PFM mode. When operating in the PFM mode, the boost converter 206 can shut down one or more of its oscillators 228 in order to conserve power.

During operations of the boost converter 206, the input signal 204 can pass through the inductor 208, which is connected to a switch 230. The switch 230 can be toggled according to a switch signal 214 in order to cause the input signal 204 to pass through the inductor 208, a diode 212, and a capacitor 232. The capacitor 232 will be periodically charged and discharged according to a switching frequency of the switch 230. As result of the charging and discharging of the capacitor 232, a voltage output 234 will be provided from the boost converter 206, which can be used to illuminate a light emitting diode (LED) string 210. For example, in some embodiments, the LED string 210 can be incorporated into a backlight of a display panel for a computing device to which the boost converter 206 is connected.

When the boost converter 206 is operating in the PFM mode, a feedback signal 246 and an LED return signal 242 can be used to determine an upper voltage limit and a lower voltage limit for the voltage output 234 of the boost converter. The LED return signal 242 can be connected to a current sink 244 of the boost converter 206. An amplifier 240 (i.e., a transconductance amplifier) can be used to feed voltage to hysteresis control 238 to selectively provide the upper voltage limit and the lower voltage limit. The upper voltage limit and/or the lower voltage limit for the voltage output 234 can be combined with an output from a current limit control 220 in order to control the voltage output 234 when the boost converter 206 is operating in the PFM mode. For example, the current limit control 220 can receive signals from the current sensor 222, a brightness input 218, and/or a PFM threshold 216 input in order to determine suitable current limits for the boost converter 206. The boost converter 206 can determine a load of the boost converter 206 based on the brightness input 218 and/or an output from the current sensor 222. Upon determined the load of the boost converter 206, an upper current limit and lower current limit can be determined by the current limit control 220. The upper current limit and zero crossing can be selected by the current limit control 220 based on a correspondence between each of the upper current limit, the zero crossing, and the load of the boost converter 206. The correspondence can be set to minimize audible tones generated when the boost converter 206 is operating at certain switching frequencies during the PFM mode. The correspondence between the upper current limit, zero crossing, and the load of the boost converter 206 can be embodied in a lookup table stored by or accessible to the boost converter 206 or current limit control 220. In this way, the boost converter 206 can select from multiple values for the upper current limit and the lower current limit depending on the load of the boost converter 206.

Once the upper current limit and the lower current limit are set by the current limit control 220, the current limit control 220 can generate an output according to whether the input signal 204 is at a value that is above the upper current limit or zero crossing. The output of the current limit control can be combined with the output from the mux 240 or an output of the hysteresis control 238, and thereafter provided to a gate drive logic 226. The gate drive logic 226 can generate a switch signal 214 for one or more switches 230 according to how each of the input signal 204 and the voltage output 234 compares to the various limits and thresholds discussed herein. For example, when the voltage output 234 reaches the upper voltage limit, the switch signal 214 can cause the switch 230 to stop switching in order to allow the voltage output 234 to decrease to the lower voltage limit. Similarly, when the input signal 204 corresponds to a current that is at the upper current limit or the zero crossing, the switch signal 214 can cause the switch 230 to toggle in order to stop or start a pulse of the input signal 204, respectively. The pulse can thereafter charge the capacitor 232 and ultimately contribute to the voltage output 234 for the LED string 210. Thereafter, the voltage output 234 can continue to be compared to the upper voltage limit and the lower voltage limit as long as the boost converter 206 is in the PFM mode. As the load of the boost converter 206 increases or decreases when operating in the PFM mode, the voltage limits and current limits can be adjusted in order to maintain the switching frequency of the switch 230 above an audible frequency (e.g., above 20 kilohertz).

Figure 3:
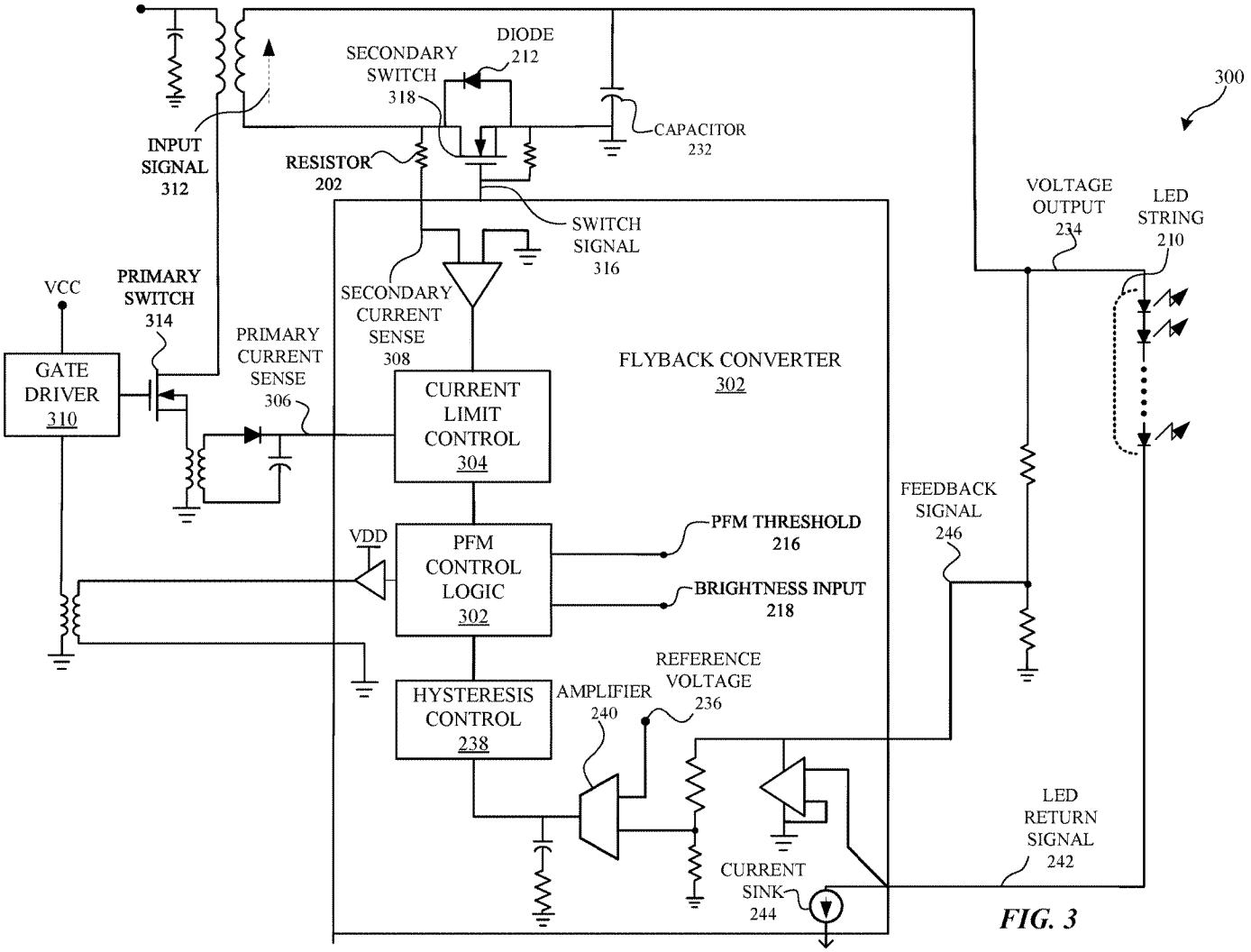
FIG. 3 illustrates a circuit diagram for controlling a flyback converter to operate at a switching frequency that is above an audible frequency range based on a primary side and secondary side transformer current measurement.

FIG. 3 illustrates a circuit diagram 300 for controlling a flyback converter 302 to operate at a switching frequency that is above an audible frequency range based on a primary side and secondary side current measurement of a transformer. The flyback converter 302 can include some of the same elements from the boost converter 206 of FIG. 2 and operate similarly to the boost converter 206 of FIG. 2. However, the flyback converter 302 can incorporate a current limit control 304 that can receive signals corresponding to a primary current sense 306 and a secondary current sense 308. Each of the primary current sense 306 and the secondary current sense 308 can correspond to current measurements from a primary side and a secondary side of a transformer connected to the flyback converter 302. The primary side can include a gate driver 310 for initiating a pulse of the input signal 312 to a secondary side of the transformer. As a result, a current will be transmitted across resistor 202 and thereafter measured as the secondary current sense 308. Additionally, a current corresponding to the primary current sense 306 can be generated and transmitted to the current limit control 304 for comparing the primary current sense 306 to an upper current limit of the current limit control 304. Furthermore, the gate driver 310 can operate a primary switch 314 for initiating and throttling the input signal 312 based on whether the voltage output 234 of the flyback converter 302 corresponds to a voltage that is equal to or above a reference voltage 236 or zero.

The voltage output 234 can be generated according to the charging and discharging of the capacitor 232, which can be controlled according to a switch signal 316 provided to a secondary switch 318 from the flyback converter 302. The switching of the secondary switch 318 can be performed according to a switching frequency that is above an audible frequency using the primary current sense 306 and the secondary current sense 308. For example, the flyback converter 302 can enter a PFM mode when a load of the flyback converter 302 or a brightness input 218 to a PFM control logic 320 is below a PFM threshold 216. Depending on the load and/or the brightness input 218, the current limit control 304 can select an upper current limit and zero crossing for the pulses generated from toggling the primary switch 314 and the secondary switch 318. For example, the secondary switch 318 can toggle when the secondary current sense 308 reaches the zero crossing (e.g., 0 amperes). Additionally, the primary switch 314 can toggle when the primary current sense 306 reaches the upper current limit. In this way, a new pulse will not be generated from the input signal 312 until both the primary current sense 306 reaches the upper current limit and thereafter the secondary current sense 308 reaches the zero crossing. The upper current limit, zero crossing, upper voltage limit, and lower voltage limit can be stored by or accessible to the flyback converter 302. The zero crossing can be determined by a zero cross detection circuit of the flyback converter 302. Furthermore, a correspondence between the upper current limit, lower current limit, upper voltage limit, lower voltage limit, and a load of the flyback converter 302 can be embodied in a lookup table as discussed herein.

Figure 4A:
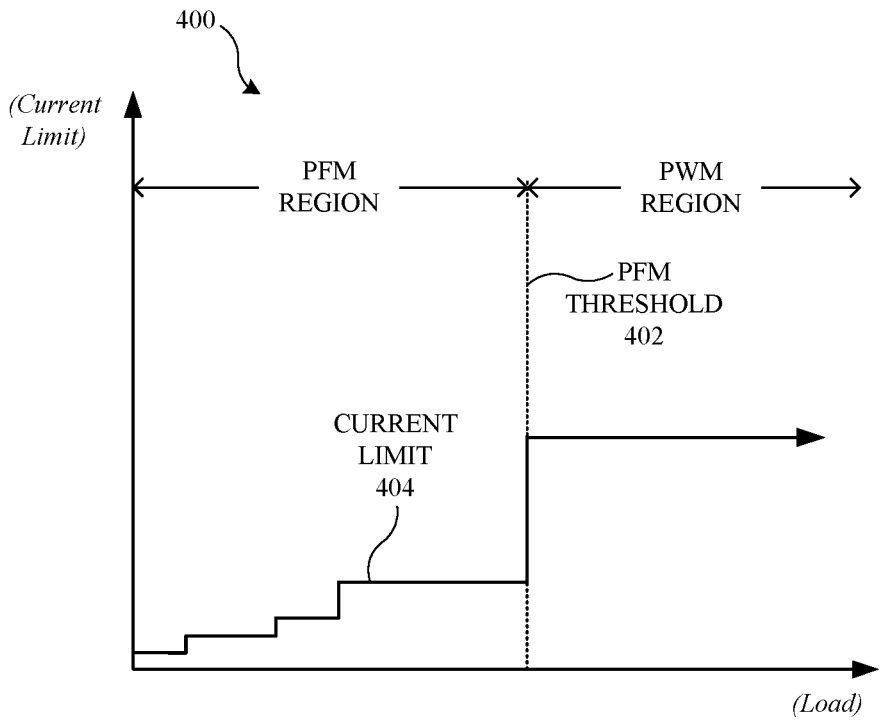
FIGS. 4A and 4B illustrate plots of examples of how audible switching frequencies can be avoided when operating a boost converter according to certain limits.
Figure 4B:
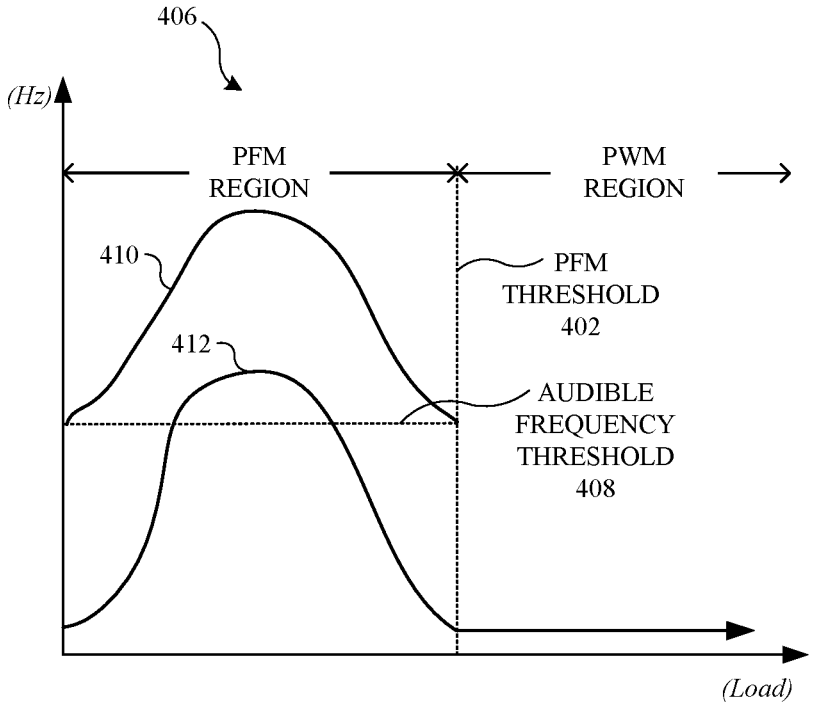

FIGS. 4A and 4B illustrate plots 400 and 410 of examples of how audible switching frequencies can be avoided when operating a boost converter according to certain limits (i.e., current limits). Specifically, plot 400 illustrates a current limit 404 being enforced when a load of the boost converter crosses a PFM threshold 402. The current limit 404 can vary according to the value of the load in order to operate the boost converter in a manner that boosts a switching frequency of the boost converter above an audible frequency. Plot 406 illustrates how the switching frequency (Hz) of the boost converter using the various limits and thresholds discussed herein. Specifically, when the boost converter exits the PWM region of operation to the PFM region of operation, one or more limits are applied to the boost converter that boost a switching frequency output 410 of the boost converter above an audible frequency threshold 408. An audible switching frequency output 412 is illustrated to show the differences in switching frequency that can be realized when one or more limits are applied to the boost converter according to the embodiments discussed herein.

Figure 5:
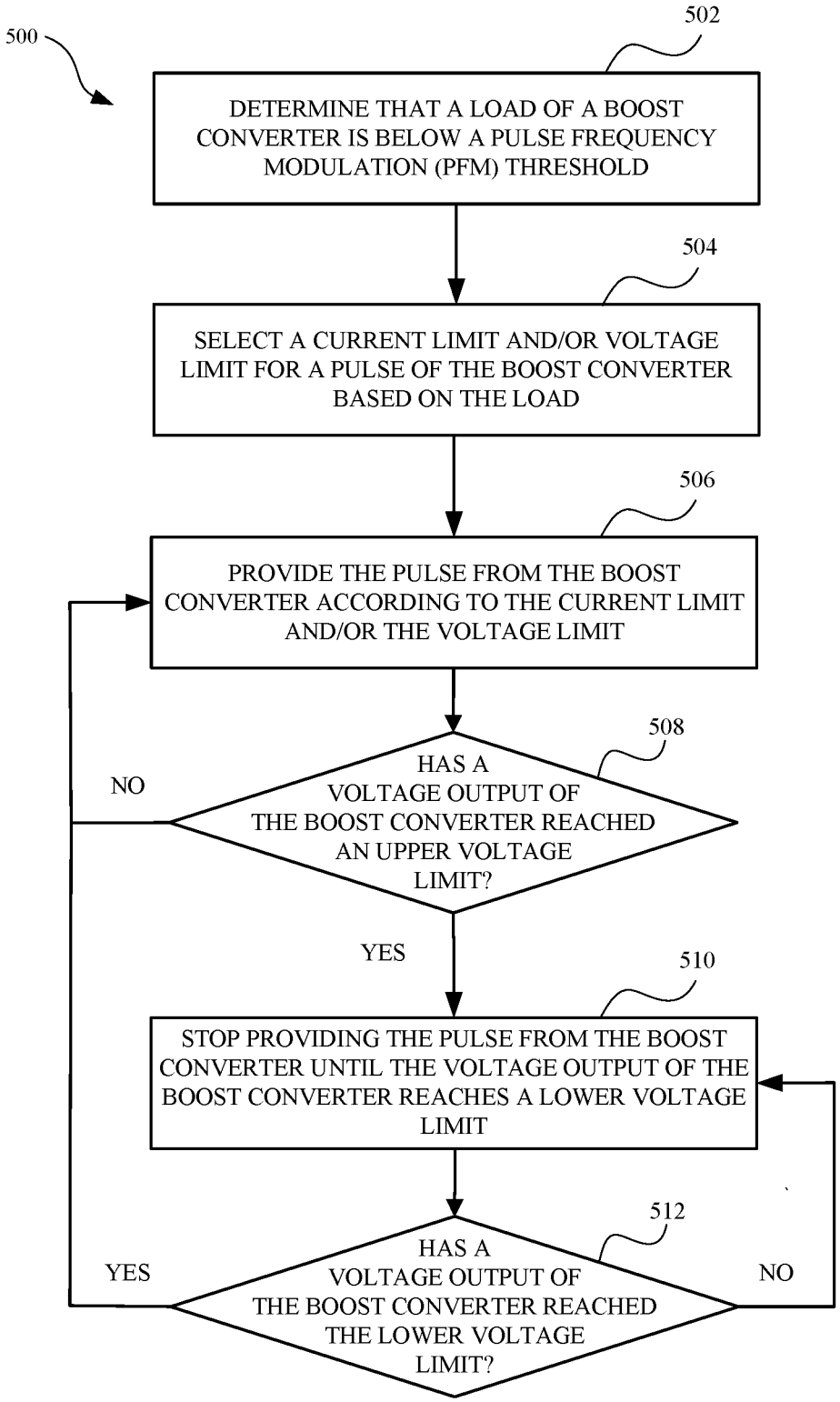
FIG. 5 illustrates a method for controlling pulses from a boost converter operating in a PFM mode in a manner that boosts a switching frequency of the boost converter above an audible frequency.

FIG. 5 illustrates a method 500 for controlling pulses from a boost converter operating in a manner that boosts a switching frequency of the boost converter above an audible frequency. The method 500 can be performed by any device, apparatus, boost converter, display driver, or any other component suitable for controlling power provided to a display panel. The method 500 can include a step 502 of determining that a load of the boost converter is below a pulse frequency modulation (PFM) threshold. At step 504, a current limit and voltage limit for a pulse of the boost converter is selected based on the load of the boost converter. The current limit and voltage limit can be stored in a lookup table that stores a correspondence between multiple current limits, voltage limits, and loads of the boost converter. The lookup table can be stored by the boost converter or accessible to the boost converter. The method 500 can further include a step 506 of providing the pulse from the boost converter according to the selected current limit and the voltage limit. At step 508, a determination is made whether the voltage output of the boost converter has reached an upper voltage limit. The upper voltage limit can correspond to the voltage limit selected at step 504. If the voltage output has reached the upper voltage limit, then at step 510 the boost converter can stop providing the pulse form the boost converter until the voltage output of the boost converter reaches a lower voltage limit. The lower voltage limit can correspond to the voltage limit selected at step 504. If the voltage output has not reached the upper voltage limit, then step 506 can be repeated. At step 512, a determination is made whether the voltage output of the boost converter has reached the lower voltage limit. If the voltage output has reached the lower voltage limit, then step 506 can be repeated and another pulse can be provided. However, if the voltage output of the boost converter has not reached the lower voltage limit, then step 510 can be repeated until the voltage output of the boost converter reaches the lower voltage limit. The current and/or voltage limits provided in the method 500 can be set to values that cause the pulses to be provided at a frequency that is outside or above an audible frequency range.

Figure 6:
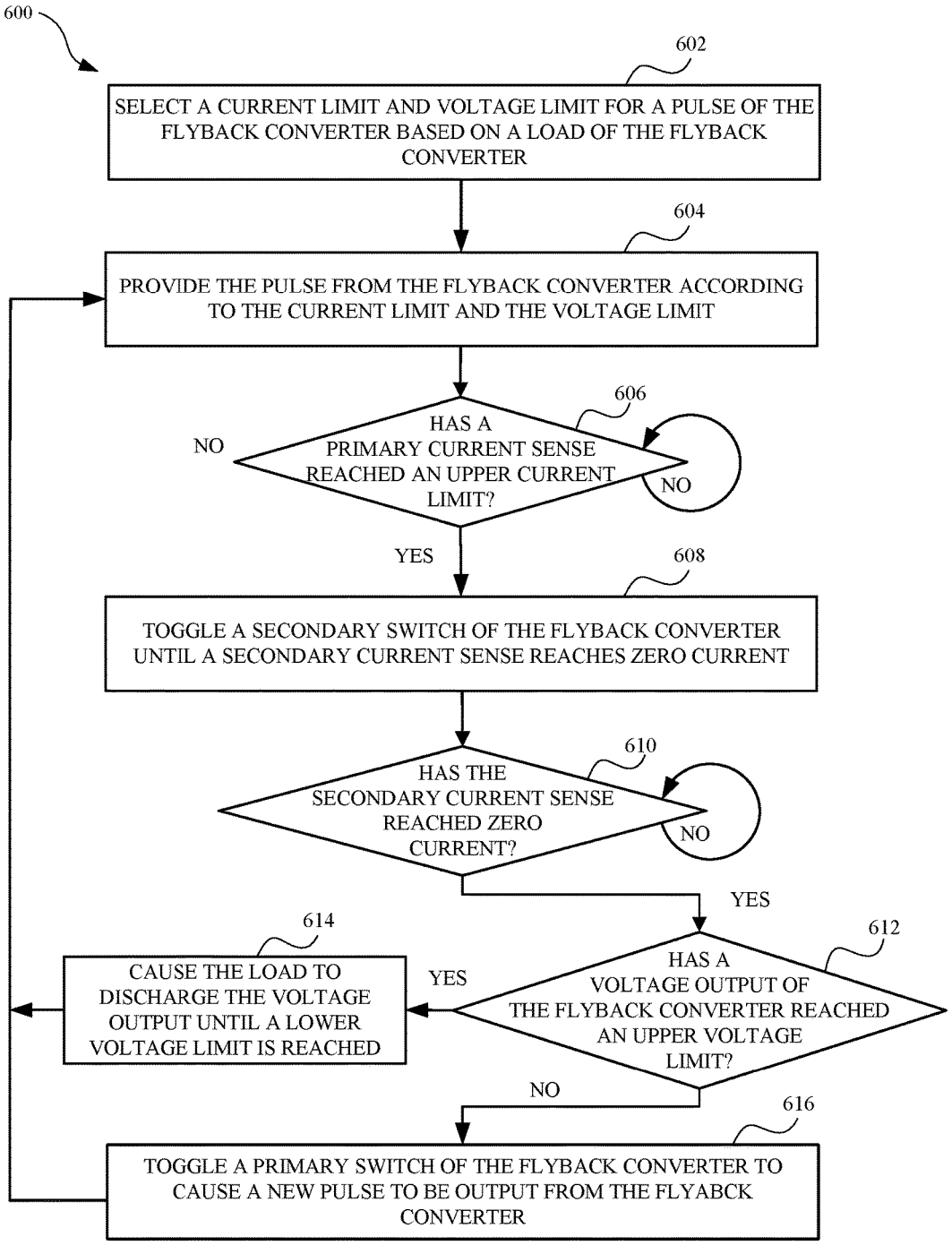
FIG. 6 illustrates a method for controlling pulses from a flyback converter operating in a PFM mode according to a primary current sense signal and a secondary current sense signal.

FIG. 6 illustrates a method 600 for controlling pulses from a flyback converter operating in a PFM mode according to a primary current sense signal and a secondary current sense signal measured by the flyback converter. The method 600 can be performed by any device, apparatus, flyback converter, display driver, or any other component suitable for controlling power provided to a display panel. The method 600 can include a step 602 of selecting a current limit and/or voltage limit for a pulse of the flyback converter based on a load of the flyback converter, as discussed herein. The method 600 can further include a step 604 of providing the pulse from the flyback converter according to the current limit and the voltage limit. At step 606, a determination is made whether a primary current sense has reached an upper current limit. The primary current sense can correspond to a current on a primary side of a transformer of the flyback converter. If the primary current sense has not reached the upper current limit then the method 600 can pause or cycle until the primary current sense reaches the upper current limit. If the primary current sense has reached the upper current limit then at step 608, a secondary switch of the flyback converter can toggle (i.e., open or close) until a secondary current sense reaches zero. At step 610, a determination is made whether the secondary current sense reaches zero. If the secondary current sense has not reached zero then the method 600 can pause or cycle until the secondary current sense reaches the zero. When the secondary current sense reaches zero, then at step 612 a determination is made whether a voltage output of the flyback converter has reached an upper voltage limit. If the voltage output of the flyback converter has reached the upper voltage limit, then at step 614, the voltage output of the flyback converter is throttled until a lower voltage limit has been reached by the voltage output. Thereafter, step 604 can be repeated. If the voltage output of the flyback converter has not reached the upper voltage limit, then at step 616, a primary switch of the flyback converter can be toggled (i.e., opened or closed) in order to start a new pulse to be output from the flyback converter. Thereafter, step 604 can be repeated. The current and/or voltage limits provided in the method 600 can be set to values that cause the pulses to be provided at a frequency that is outside or above an audible frequency range.

Figure 7:
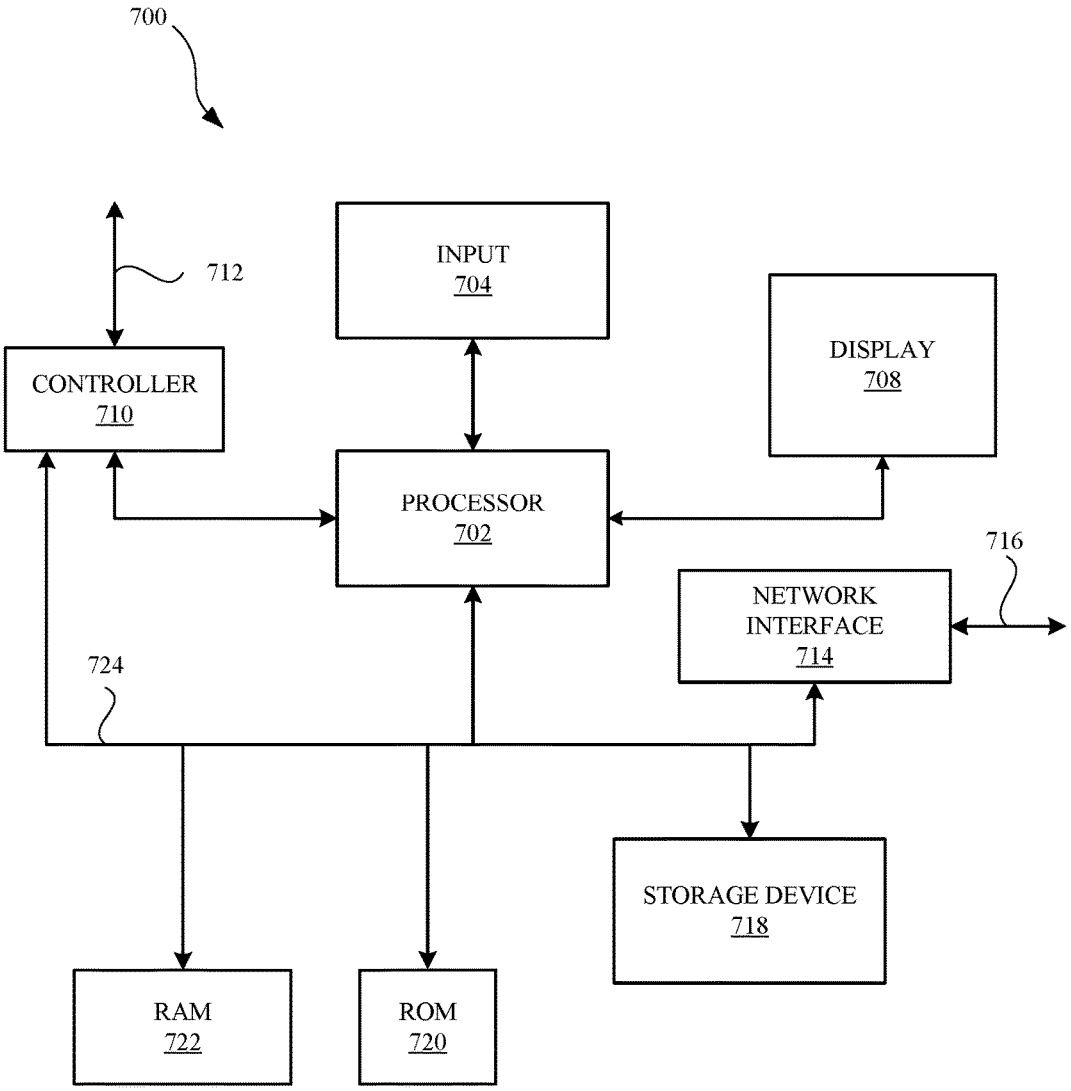
FIG. 7 is a block diagram of a computing device that can represent the components of the computing device, display panel, display controller, and/or boost converter discussed herein.

FIG. 7 is a block diagram of a computing device 700 that can represent the components of the computing device, display panel, display controller, flyback converter, and/or boost converter discussed herein. It will be appreciated that the components, devices or elements illustrated in and described with respect to FIG. 7 may not be mandatory and thus some may be omitted in certain embodiments. The computing device 700 can include a processor 702 that represents a microprocessor, a coprocessor, circuitry and/or a controller 710 for controlling the overall operation of computing device 700. Although illustrated as a single processor, it can be appreciated that the processor 702 can include a plurality of processors. The plurality of processors can be in operative communication with each other and can be collectively configured to perform one or more functionalities of the computing device 700 as described herein. In some embodiments, the processor 702 can be configured to execute instructions that can be stored at the computing device 700 and/or that can be otherwise accessible to the processor 702. As such, whether configured by hardware or by a combination of hardware and software, the processor 702 can be capable of performing operations and actions in accordance with embodiments described herein.

The computing device 700 can also include user input device 704 that allows a user of the computing device 700 to interact with the computing device 700. For example, user input device 704 can take a variety of forms, such as a button, keypad, dial, touch screen, audio input interface, visual/image capture input interface, input in the form of sensor data, etc. Still further, the computing device 700 can include a display 708 (screen display) that can be controlled by processor 702 to display information to a user. Controller 710 can be used to interface with and control different equipment through equipment control bus 712. The computing device 700 can also include a network/bus interface 714 that couples to data link 716. Data link 716 can allow the computing device 700 to couple to a host computer or to accessory devices. The data link 716 can be provided over a wired connection or a wireless connection. In the case of a wireless connection, network/bus interface 714 can include a wireless transceiver.

The computing device 700 can also include a storage device 718, which can have a single disk or a plurality of disks (e.g., hard drives) and a storage management module that manages one or more partitions (also referred to herein as "logical volumes") within the storage device 718. In some embodiments, the storage device 718 can include flash memory, semiconductor (solid state) memory or the like. Still further, the computing device 700 can include Read-Only Memory (ROM) 720 and Random Access Memory (RAM) 722. The ROM 720 can store programs, code, instructions, utilities or processes to be executed in a non-volatile manner. The RAM 722 can provide volatile data storage, and store instructions related to components of the storage management module that are configured to carry out the various techniques described herein. The computing device 700 can further include data bus 724. Data bus 724 can facilitate data and signal transfer between at least processor 702, controller 710, network/bus interface 714, storage device 718, ROM 720, and RAM 722.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line. The computer readable medium is any data storage device that can store data which can thereafter be read by a computer system. Examples of the computer readable medium include read-only memory, random-access memory, CD-ROMs, HDDs, DVDs, magnetic tape, and optical data storage devices. The computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A boost converter for a display panel, the boost converter comprising:

a logic circuit configured to switch the boost converter into a pulse width modulation (PWM) mode when a load of the boost converter is above a load threshold and a pulse frequency modulation mode (PFM) mode when the load of the boost converter is equal to or below the load threshold; and a PFM controller configured to monitor a current output of the boost converter and limit the current output to one of a plurality of predetermined current limits for the PFM mode, each of the predetermined current limits associated with a load range of the boost converter and each configured to maintain the current output for the associated load range to a current associated with a switching frequency above a predetermined frequency threshold, wherein the predetermined frequency threshold is greater than or equal to 20 kilohertz.

2. The boost converter of claim 1, wherein the PFM controller is further configured to select the one of the plurality of predetermined current limits according to a brightness input to the boost converter.

3. The boost converter of claim 1, wherein each of the plurality of predetermined current limits comprises an upper current limit stored at the boost converter.

4. The boost converter of claim 1, wherein each of the predetermined current limits is a range of current values.

5. The boost converter of claim 1, wherein the PFM controller is configured to select a variable voltage output or static output voltage for the boost converter.

6. The boost converter of claim 1, wherein the PFM controller is configured to disconnect an oscillator of the boost converter when the load of the boost converter is equal to or below the load threshold.

7. A method for operating a boost converter above a predetermined frequency, the method comprising:

by the boost converter:

switching from a pulse width modulation mode (PWM) to a pulse frequency modulation (PFM) mode when a load of the boost converter is below a predetermined load threshold;

outputting a series of pulses from the boost converter; and throttling the series of pulses when the series of pulses cause a voltage output of the boost converter to reach a voltage threshold, wherein the voltage threshold is configured to maintain a frequency of the series of pulses equal to or above 20 kilohertz.

8. The method of claim 7, wherein a voltage output of the boost converter is throttled when the series of pulses corresponds to an upper voltage limit of the voltage threshold.

9. The method of claim 8, further comprising:

comparing a sensed inductor current to a current limit accessible to the boost converter.

10. The method of claim 9, further comprising:

selecting the current limit from a plurality of current limits accessible to the boost converter, wherein the current limit is selected based on a correspondence between the current limit and the load of the boost converter.

11. The method of claim 10, wherein the correspondence between the current limit and the load of the boost converter is embodied as a lookup table that is accessible to the boost converter.

12. The method of claim 7, wherein switching from the PWM mode to the PFM mode includes disabling an oscillator of the boost converter.

13. The method of claim 7, further comprising:

selecting the voltage threshold from a plurality of voltage thresholds accessible to the boost converter.

* * * * *